US006292133B1

(12) United States Patent
Lynch

(10) Patent No.: US 6,292,133 B1
(45) Date of Patent: Sep. 18, 2001

(54) ARRAY ANTENNA WITH SELECTABLE SCAN ANGLES

(75) Inventor: Michael J. Lynch, Merritt Island, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/361,082

(22) Filed: Jul. 26, 1999

(51) Int. Cl.[7] ..... H01Q 3/22; H01Q 3/24; H01Q 3/26

(52) U.S. Cl. ..... 342/368; 342/372; 343/700 MS

(58) Field of Search ..... 342/368, 372; 343/700 MS

(56) References Cited

U.S. PATENT DOCUMENTS

| | | | |
|---|---|---|---|
| 4,218,682 | | 8/1980 | Yu . |
| 4,543,579 | | 9/1985 | Teshirogi . |
| 4,633,262 | | 12/1986 | Traut . |
| 4,737,793 | | 4/1988 | Munson et al. . |
| 4,791,428 | | 12/1988 | Anderson . |
| 4,887,089 | | 12/1989 | Shibata et al. . |
| 4,914,448 | | 4/1990 | Otsuka et al. . |
| 4,958,165 | | 9/1990 | Axford et al. . |
| 5,181,042 | | 1/1993 | Kaise et al. . |
| 5,189,433 | | 2/1993 | Stern et al. . |
| 5,210,541 | | 5/1993 | Hall et al. . |
| 5,214,436 | * | 5/1993 | Hannan ..... 343/705 |
| 5,231,406 | | 7/1993 | Sreenivas . |
| 5,270,721 | | 12/1993 | Tsukamoto et al. . |
| 5,561,434 | | 10/1996 | Yamazaki . |
| 5,689,276 | | 11/1997 | Uematsu et al. . |
| 5,714,961 | | 2/1998 | Kot et al. . |
| 6,094,161 | * | 7/2000 | Cassen et al. ..... 342/175 |

* cited by examiner

*Primary Examiner*—Theodore M. Blum
(74) *Attorney, Agent, or Firm*—Allen, Dyer, Doppelt, Milbrath & Gilchrist, P.A.

(57) ABSTRACT

An array antenna includes a dielectric substrate layer having opposing sides. A ground plane conductor is positioned on one side of the dielectric substrate layer. A plurality of antenna elements, such as slots, are formed within the ground plane conductor. The antenna elements are arranged to form an array. A plurality of signal tracks, such as striplines, extend along the side of the dielectric substrate layer opposing the ground plane conductor. The respective striplines extend under each antenna element. A plug-in card slot is operatively connected to the plurality of striplines and adapted for receiving a plug-in card and connecting to a plurality of striplines within the plug-in card to have a desired phase shift to scan the beam to a desired location.

17 Claims, 8 Drawing Sheets

MAINE
CONNECTOR M

FLORIDA
CONNECTOR F

ARRAY ANTENNA WITH SELECTABLE SCAN ANGLES

FIELD OF THE INVENTION

This invention relates to the field of phase array antennas, and more particularly, this invention relates to the field of phase array antennas as applied for satellite communication or terrestrial point-to-point applications.

BACKGROUND OF THE INVENTION

Terrestrial point-to-point communications links often used parabolic antennas mounted on the roof or sides of buildings. Households in residential areas typically use a parabolic antenna to receive electromagnetic waves from a broadcast satellite. Because this type of satellite dish has a beam that points out of a reflector, it must be mounted away from the house in order to tilt the dish and point it at the sky. The dish is sometimes also mounted on the roof or balcony of a house and directed at a satellite. This type of dish antenna typically comprises a reflector, feedhorn element and a converter, with the feedhorn and converter disposed on the focal position of the reflector. In heavy winds, the satellite dish can be broken. Additionally, a parabolic antenna is sometimes unsitely and spoils the aesthetic appearance of many buildings or houses.

A planar antenna can sometimes be used and placed directly on the side of the building or house to add strength to the antenna and also make its appearance more aesthetic. However, if the beam comes directly out of the surface ("on bore site"), the antenna will be directed at the building next door when mounted on a vertical surface.

Some microstrip array antennas have been designed to have a beam tilt such that a beam radiated from the antenna is deviated from a direction perpendicular to the plane of the antenna. For example, an antenna could be given a beam tilt of 23 or 27 degrees. The beam tilt can be obtained by giving phase differences to a plurality of radiating elements that constitute a phase array. An example of such antenna is disclosed in U.S. Pat. No. 5,181,042 to Kaise et al., where a planar microstrip array antenna has a beam tilt that is formed from a plurality of pairs of circularly polarized wave radiating elements.

However, the Kaise et al. patent, the disclosure which is hereby incorporated by reference in its entirety, has one fixed scan angle and the beam scan is fixed in the beam-former. No adjustment, or more importantly, selection of possible scan angles is possible.

U.S. Pat. No. 5,189,433 to Stern et al., the disclosure which is hereby incorporated by reference in its entirety, discloses a slotted microstrip electronic scan antenna where a network of striplines are mounted on an opposed surface of a dielectric substrate. A scanning circuit is connected to control terminals of circulators for selectively completing a radio frequency transmission path between an input/output stripline and coupling striplines. Each linear array is directional, having a major lobe and each major lobe is oriented in a different direction. The scanning circuit is periodically switched between the linear arrays, and causes the antenna to scan a region of space via a different major lobe. Although the beam can be scanned, the Stern et al. solution is not a simple low cost implementation, such as could be used for terrestrial point-to-point or TV receive applications where an electrical scan capability would not be required as in the Stern et al. patent.

U.S. Pat. No. 5,210,541 to Hall et al., the disclosure which is hereby incorporated by reference in its entirety, discloses a patch antenna array having multiple beam-forming capability using a feed network on a microstrip substrate with patches overlaying an upper substrate. Linear series-connected patch arrays are each resonant and may have open circuits at each end. A traveling wave arrangement of feed lines is provided, and in one embodiment, the total number of beams can be generated as twice the number of feed lines. Again, a simplified selectable structure to scan the beam to a desired location such that a user can obtain a desired and scanned beam at a predetermined location is not disclosed.

SUMMARY OF THE INVENTION

It is therefore an object of the present invention to provide a phase array antenna that allows a user to select a desired beam angle in a simplified phase array antenna structure.

It is still another object of the present invention to provide an array antenna where a user can quickly select a beam angle to scan the beam based on the location of the array antenna and the location of a satellite of interest.

In one aspect of the present invention, a planar configured housing mounts a dielectric substrate layer and other elements of a phase array antenna. A frame supports the housing and is adapted to be placed on a planar support surface, such as chimney or side of a house. The housing may be rotated relative to the frame for adjusting azimuth. In still another aspect of the present invention, a plug-in card can be inserted within a plug-in card slot. The plug-in card has a plurality of signal tracks operatively connected to respective signal tracks extending along the substrate layer. Each of the signal tracks within the plug-in card is formed to have a desired phase shift to scan the beam to a desired location.

In still another aspect of the present invention, a second dielectric substrate layer can be positioned under patch antenna elements that are positioned along the side of a dielectric substrate layer opposing the slotted ground plane conductor. Striplines extend along the second dielectric substrate layer positioned under the patch antenna elements.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention now provides a phase array antenna that is simple in construction and allows a user to select a desired beam scan angle, such as based on the direction where the phase array antenna is positioned on the building or house, and geographically positioned at a location.

Figure 1:
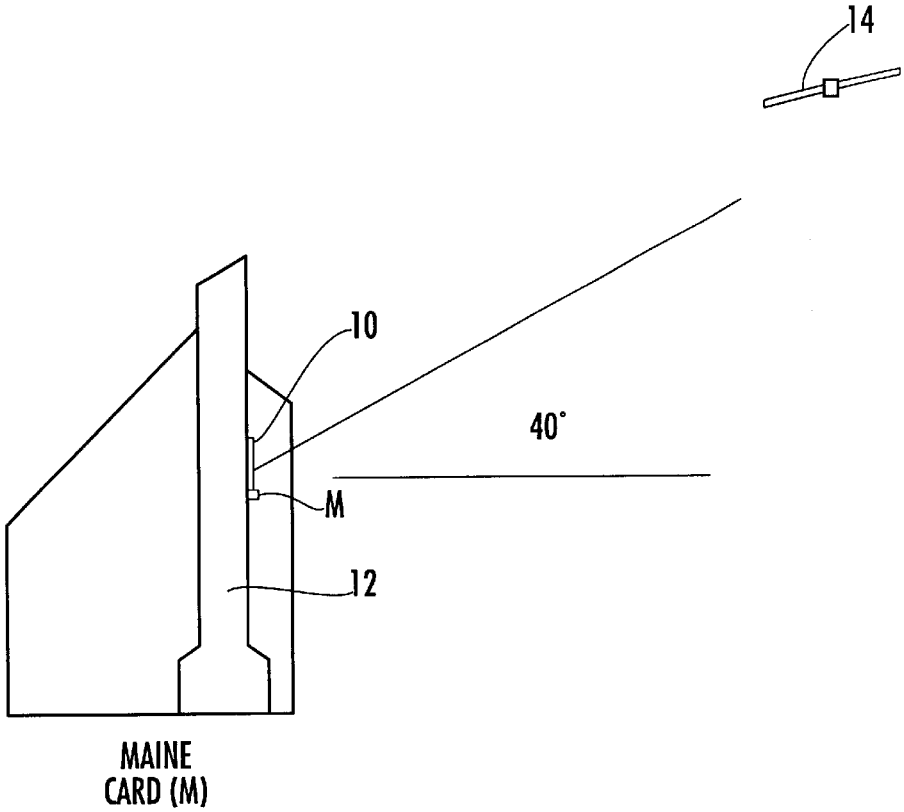
FIG. 1 is a schematic view showing a planar phase array antenna of the present invention with one card inserted that produces a main beam located 40° off bore site.
Figure 2:
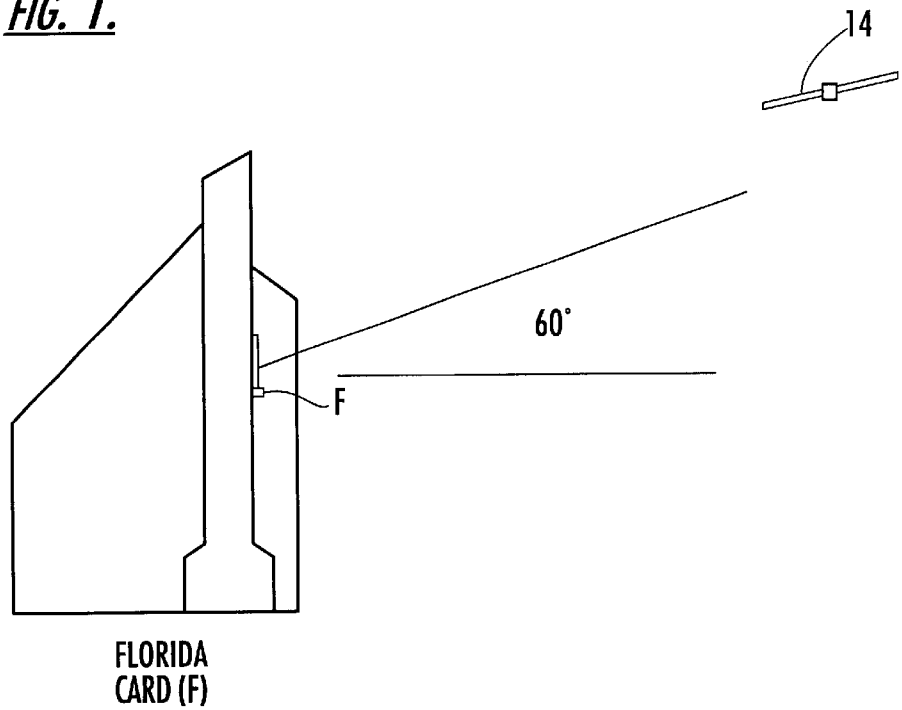
FIG. 2 is another view similar to FIG. 1 showing the phase array antenna of the present invention with a second card producing a main beam located 60° off bore site.
Figures 3, 3A:
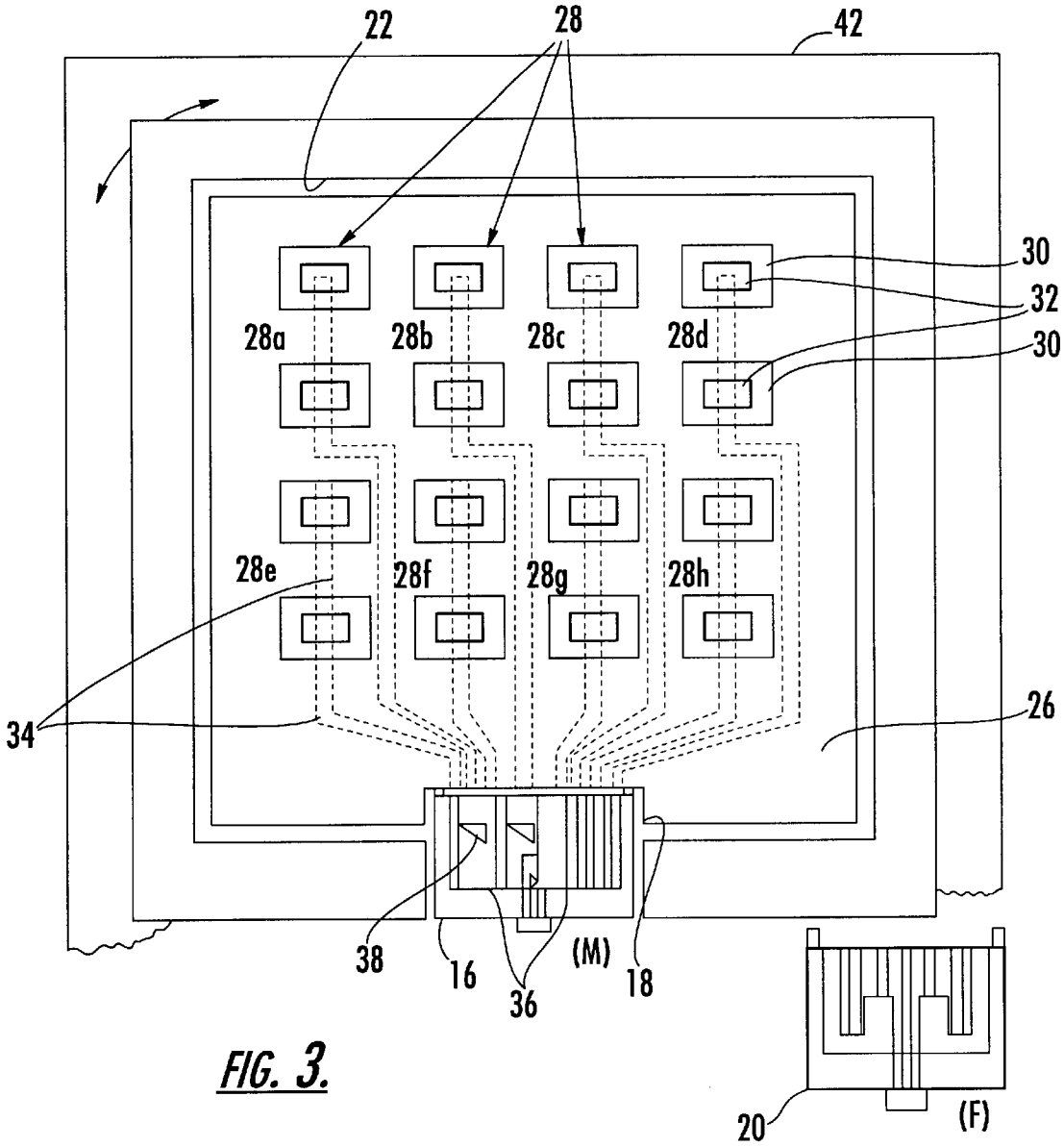
FIG. 3 is a schematic top plan view of one example of a phase array antenna of the present invention showing antenna elements and a plug-in card inserted within a plug-in card slot.
FIG. 3A is an example of another plug-in card that could be plugged into the plug-in card slot.

FIGS. 1 and 2 illustrate an array antenna 10 of the present invention that is positioned on the chimney 12 of a house and receives television signals from a satellite 14. The array antenna is described herein as a phased array antenna, although the invention is not limited to a phased array antenna. In FIGS. 1 and 3, a plug-in card 16 labeled M is inserted within a plug-in card slot 18 and allows a 40° beam tilt, such as may be required when receiving signals from a satellite 14 in a state such as Maine, as an example only. Naturally, any angles are dependent on which satellite the antenna will be pointed at. FIGS. 2 and 3A shows a different plug-in card 20 labeled F that is inserted within a plug-in card slot to give a beam tilt of 60°, such as may be required in Florida.

Figure 2A:
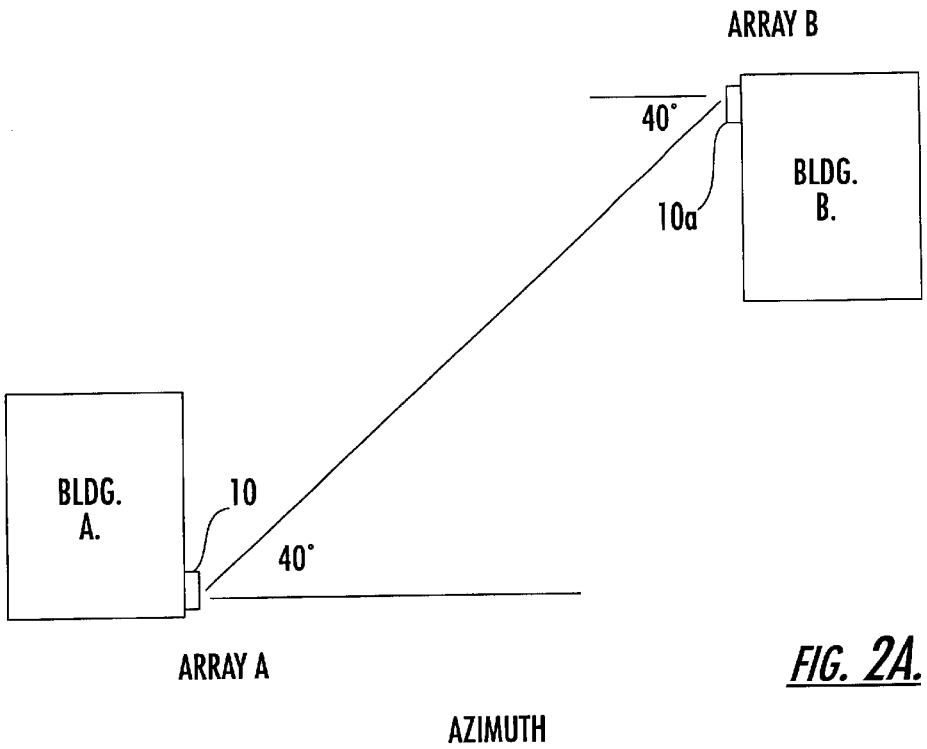
FIGS. 2A and 2B are schematic drawings showing a terrestrial application and respective azimuth and elevation views.
Figure 2B:
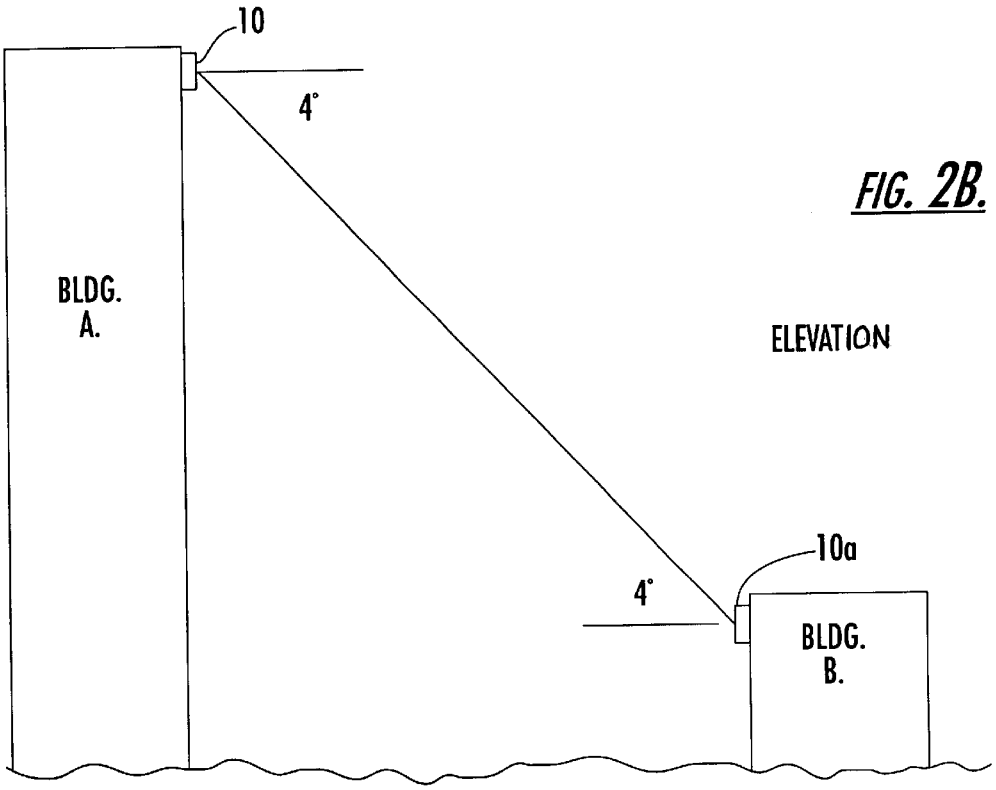

FIGS. 2A and 2B illustrate a terrestrial view using buildings A and B where an array antenna 10 is positioned on building A and array antenna 10*a* is positioned on building B and showing both azimuth and elevation views. In this case, azimuth and elevation scan angles are shown. It should be understood that for terrestrial point-to-point applications, it could be possible to select only azimuth or elevation scan angles with the other axis fixed at some predetermined angle. Scanning in one axis would be less expensive than to have the array antenna with a two axis scan.

Figure 5:
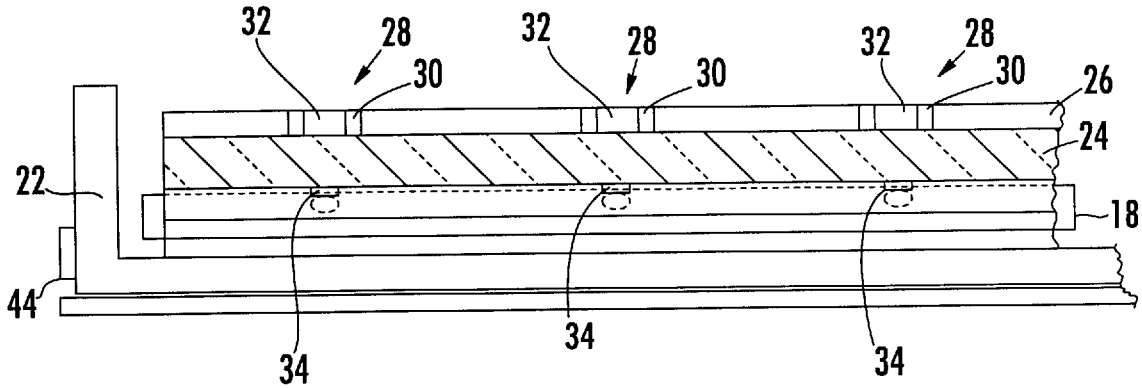
FIG. 5 is a partial, schematic sectional view of a portion of the phase array antenna of FIG. 3 showing the dielectric substrate layer, ground plane conductor, antenna elements formed as slots and strip lines, and a portion of the plug-in card slot.

A phase array antenna 10 of the present invention is shown in greater detail in FIGS. 3 and 5, which illustrates a substantially planar configured housing 22 that supports a dielectric substrate layer 24 having opposing sides and mounted within the housing 22. A dielectric substrate layer 24 can be formed by materials known to those skilled in the art. As shown in the sectional view of FIG. 5, a ground plane conductor 26 is positioned on one side of the dielectric substrate layer 24. Antenna elements 28 are formed within the ground plane conductor 26 and arranged to form an array, which in the plan view of FIG. 3, are shown as 16 different antenna elements.

In one aspect of the present invention, as shown in FIG. 5, each antenna element 28 is formed by a slot 30 within the ground plane conductor 26 and a patch antenna element 32 is formed within each of the slots, such as by leaving part of the ground plane conductor 26 within the slot 30 or by inserting a conductive element, as is well known to those skilled in the art.

In the illustrated embodiment of FIG. 3, a plurality of signal tracks 34 are formed as striplines and extend along the side of the dielectric substrate layer 24 opposing the ground plane conductor. Although one embodiment of the signal tracks are illustrated as striplines, other types of signal tracks known to those skilled in the art are possible. Respective striplines extend under each slot 30 and extend to antenna elements 28*a–h*. The antenna elements can be formed as described above. The antenna elements 28*a–h* have striplines that extend to a plug-in card slot 30 that is operatively connected to the plurality of striplines. As noted before, the plug-in card slot 18 is adapted for receiving a plug-in card 16,20.

FIG. 3 illustrates a plug-in card 16 that is inserted within the plug-in card slot 18 and shows striplines 36 that have a desired configuration to scan the beam to a desired location. For example, the plug-in cards have phase shifters 38 within some of the strip lines to cause a phase shift, such as obtained by giving phase differences to the different antenna elements 28 constituting the array. The phase delay can be caused between the two adjacent antenna elements and can be adjusted as desired by means of different plug-in cards 16,20, having different striplines, and could include different length striplines and phase shifters as illustrated in FIG. 3A. Also, the plug-in cards 16,20 could be designed to have striplines or other signal tracks, as known to those skilled in the art, and can give a desired phase shift, and thus, a different beam angle.

The dielectric substrate layer 24 and other portions of the phase array antenna 10 are enclosed within the planar configured housing 22 that is mounted onto a frame 42. The plug-in card 16 typically could have lock fasteners that lock onto the housing 22 to prevent the plug-in card 16 from accidentally being removed from the plug-in card slot 18. The frame 42 can support the housing 22. The frame 42 can typically be adapted to be placed on a planar support surface such as a chimney or wall of a house. The frame 42 and housing 22 are mounted relative to each other such that the housing may be rotated relative to the frame for adjusting azimuth. Thus, not only can the beam angle be adjusted, but it is possible to adjust azimuth on the beam angle by slightly rotating the housing 22 relative to the frame.

Figure 5A:
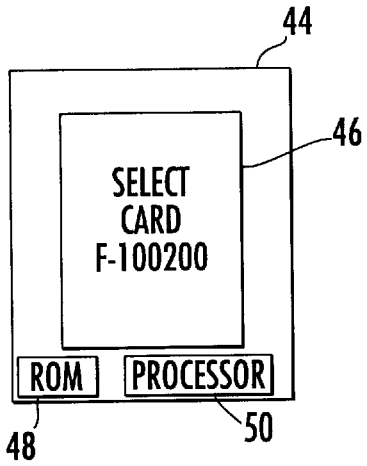
FIG. 5A is a schematic view of the directional guide and display that can be used with the antenna of the present invention.

In one aspect of the present invention, a directional guide 44 can be positioned on the housing 22. Although not necessary for function, a directional guide could be used. This directional guide 44 indicates the direction in which the phase array antenna has been mounted on an object, such as the chimney. For example, the directional guide 44 would indicate that the phase array antenna is mounted in Florida facing south or southeast. A display 46 on the directional guide (FIG. 5A) indicates what plug-in card a user would have to mount within the plug-in slot 18. The directional guide could have a ROM chip 48 and appropriate processor 50 and software that allows a user to input their geographical location, such as Florida or Maine.

After inputting this geographical information, the directional guide 44 would then determine the orientation of the phase array antenna as it is mounted on the chimney or wall of a house, and based on that determined orientation, indicate on the display what particular plug-in card would best be desirable, such as serial number F100200. The user and purchaser of the phase array antenna of the present invention could be directed initially by instructions to place the phase array antenna on a certain desired wall, such as the north or east wall.

Figure 6:
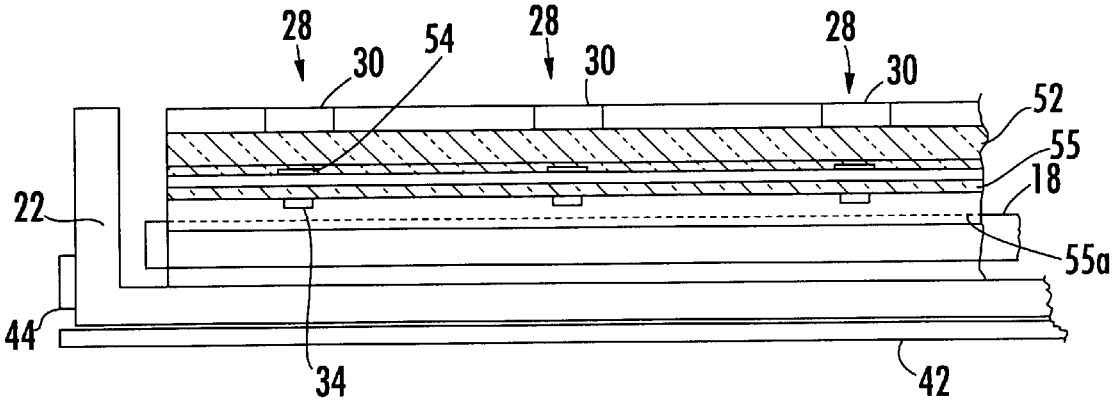
FIG. 6 is another view similar to FIG. 5, but showing an additional patch element substrate layer underlying the ground plane conductor.

FIG. 6 illustrates a sectional view of another example of a phase array antenna 10 of the present invention where a patch element substrate layer 52 underlies the ground plane conductor 26 and includes a plurality of patch antenna elements 32 formed on the patch element substrate layer 52. A respective patch antenna element 54 is positioned underneath each respective slot 30 as illustrated, and can be formed by techniques known to those skilled in the art. A second dielectric layer 55 can be positioned under the patch element substrate layer, followed by another signal track layer 55*a* having the formed signal tracks 34, which could be formed as striplines. Thus, separate patch antenna elements do not have to be formed within the slots 30 as in the embodiment shown in FIG. 5.

Figures 4, 4A:
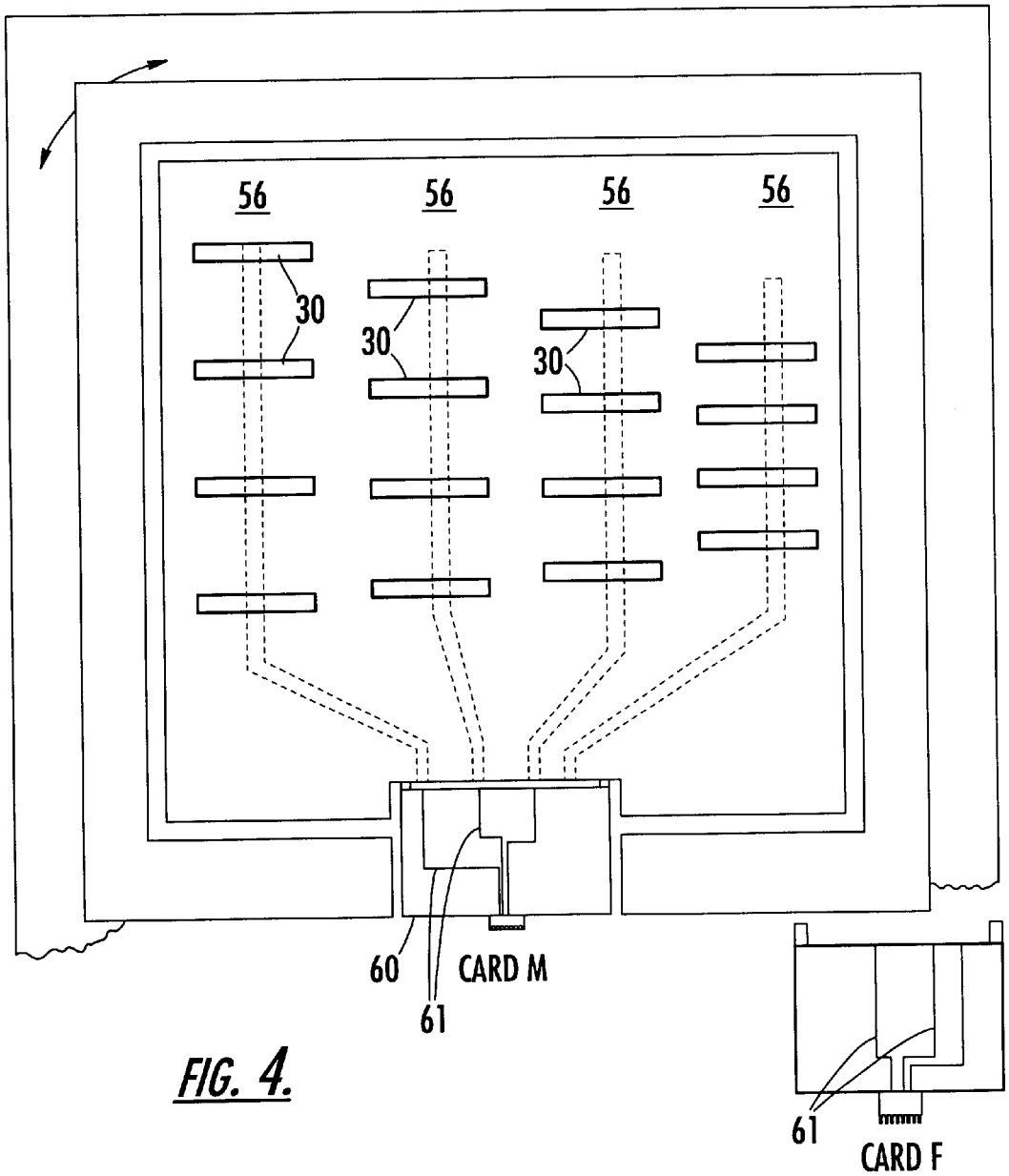
FIG. 4 is another example of a phase array antenna of the present invention showing rows of slots having signal tracks formed as strip lines and extending under the rows of slots, and a plug-in card inserted within the plug-in slot.
FIG. 4A is another example of a plug-in slot.

FIG. 4 illustrates still another example of the present invention where the slots 30 are formed in predetermined rows 56, and signal tracks, which can be formed as striplines, extend under respective predetermined rows. Each row 56 has a predetermined slot spacing and is dimensioned for receiving a predetermined center operating frequency of a receive signal. A plug-in card 60 has selected striplines 61 that connect to predetermined rows. Naturally, it is possible to have a plug-in card that has one stripline connecting to a desired stripline of a predetermined row or a number of rows. For example, card M shows the card connecting to three striplines on rows A, B and C, and card F would be connected to rows B, C and D.

Although only four rows of slots are illustrated, more than four rows could be used and a plug-in card 16 could have the appropriate striplines that connect to the desired rows.

The slots 30 receive RF energy in accordance with well known principles. The slots 30 are dimensioned and related to the center operating frequency, known to those skilled in the art.

Figure 7:
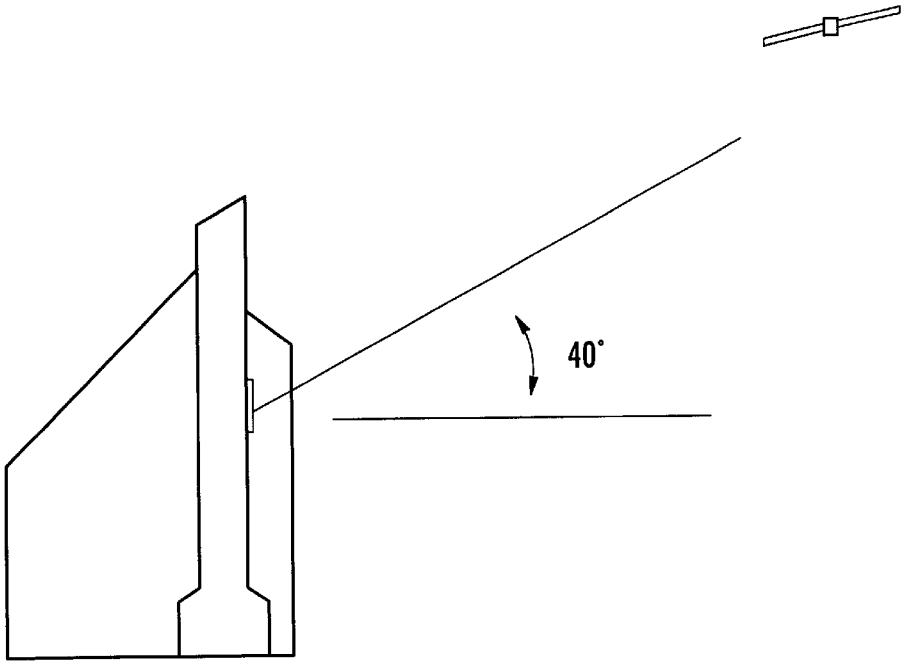
FIG. 7 is another view similar to FIG. 1 showing a phase array antenna in accordance with another embodiment of the invention where a connector M gives a 40° beam tilt.
Figure 8:
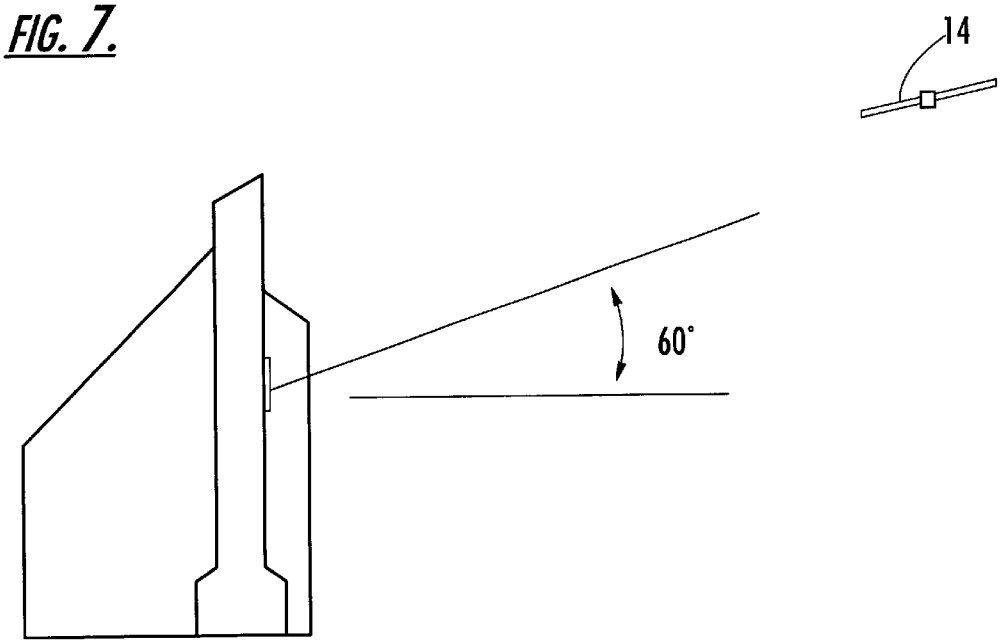
FIG. 8 is another view similar to FIG. 7 showing a connector F that gives a 60° beam tilt.
Figure 9:
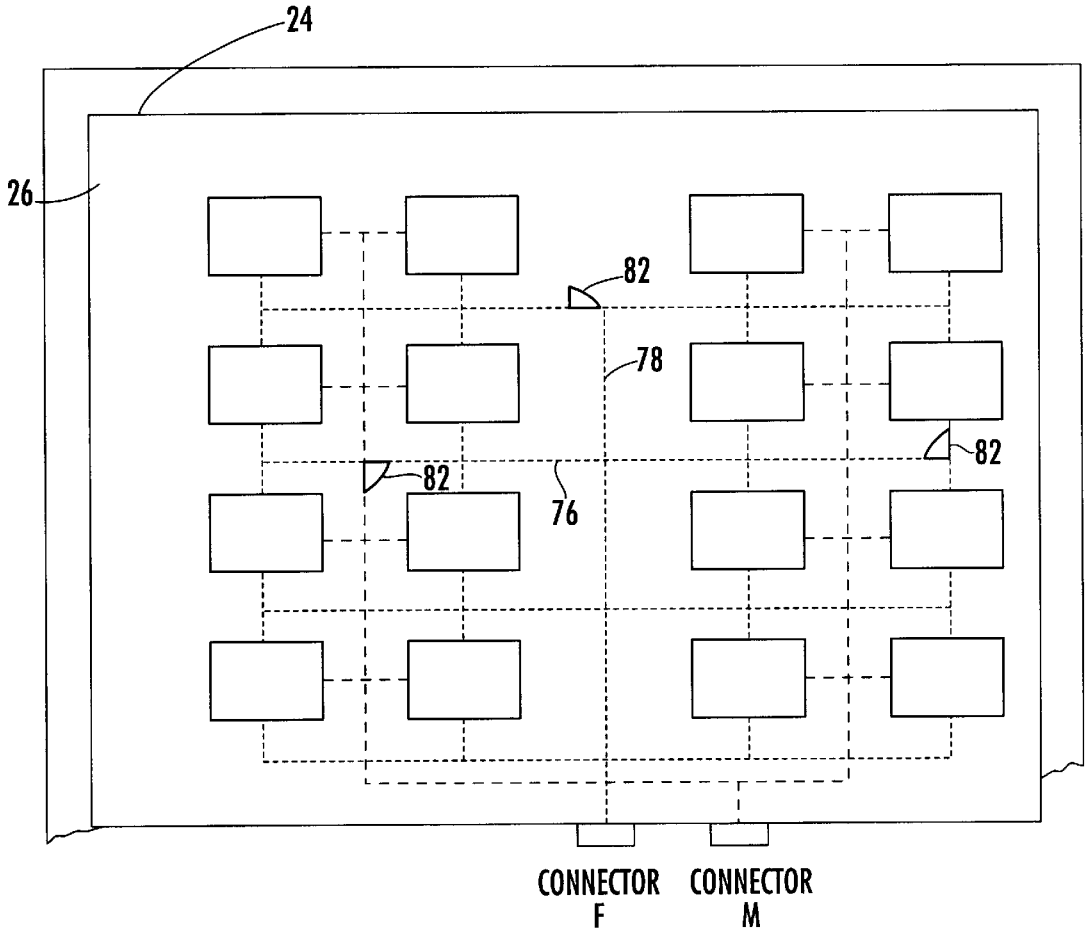
FIG. 9 is a schematic, plan view of another embodiment showing two signal tracks that could be formed as striplines and extending to paired antenna elements.

FIGS. 7 and 8 illustrate views similar to FIGS. 1 and 2. However, a connector instead of a plug-in card is used where a desired connector is attached by a user with a television cable or other similar cable to obtain the desired beam tilt. FIG. 9 shows the use of controlled impedance signal tracks 34 that could be formed as a stripline.

FIG. 9 illustrates an embodiment where antenna elements 28*a–h* are fed to respective signal tracks through a dielectric layer. A separate patch element substrate layer could be added having patch antenna elements. The dashed lines 76 indicate a signal track at a first intermediate signal path layer, and the dotted lines 78 indicate a signal track at a second intermediate signal path layer. It is evident that the signal tracks extend to different elements, and some of the signal tracks have different phase shifters 82 or other components that could cause a different phase shift and beam angle depending on whether a user connects to one of the connectors shown as connector F or connector M. For example, if a user connects a line to connector F, a desired beam shift occurs when the array antenna is mounted on the chimney in Florida. When a user connects to connector M, the beam angle could be elevated differently such as desired when the array is mounted on a chimney in Maine.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An array antenna comprising:

a dielectric substrate layer having opposing sides;

a ground plane conductor positioned on one side of said dielectric substrate layer;

a plurality of antenna elements formed within the ground plane conductor, wherein said antenna elements are arranged to form an array;

a plurality of signal tracks extending along the side of the dielectric substrate layer opposing the ground plane conductor, wherein respective signal tracks extend under each antenna element;

a plug-in card slot operatively connected to said plurality of signal tracks and adapted for receiving one of a plurality of plug-in cards and connecting to a plurality of signal tracks within said plug-in card to have a desired phase shift to scan the beam to a desired, fixed location; and a directional guide for indicating direction in which the phase array antenna has been mounted on an object, and including a display indicating a plug-in card that should be mounted within said plug-in slot.

2. An array antenna according to claim 1, wherein said ground plane conductor further comprises a patch antenna element formed at each of said antenna elements.

3. An array antenna according to claim 1, wherein said antenna elements further comprise slots that are arranged in rows, wherein respective signal tracks extend under respective rows.

4. An array antenna according to claim 3, wherein each row has a predetermined slot spacing and dimension for receiving a predetermined center operating frequency of a received signal.

5. An array antenna according to claim 3, wherein said signal tracks each include a patch antenna element positioned underneath each slot.

6. An array antenna comprising:

a dielectric substrate layer having opposing sides;

a ground plane conductor positioned on one side of said dielectric substrate layer;

a plurality of antenna elements formed within the ground plane conductor, wherein said antenna elements are arranged to form an array;

a plurality of signal tracks extending along the side of the dielectric substrate layer opposing the ground plane conductor, wherein respective signal tracks extend under each antenna element;

a plug-in card slot operatively connected to said plurality of signal tracks;

a plug-in card that had been selected out of a plurality of plug-in cards and inserted within said plug-in card slot, wherein said plug-in card has a plurality of signal tracks operatively connected to respective signal tracks extending along said substrate layer, wherein each of said signal tracks within said plug-in card are formed to have a desired phase shift to scan the beam to a desired, fixed location; and a directional guide for indicating direction in which the phase array antenna has been mounted on an object, and including a display indicating the plug-in card that had been selected to be mounted within said plug-in slot.

7. An array antenna according to claim 6, wherein said ground plane conductor further comprises a patch antenna element formed at each of said antenna elements.

8. An array antenna according to claim 6, wherein said signal tracks of said plug-in card has fixed line lengths determined by the desired phase shift.

9. An array antenna according to claim 6, wherein each of said signal tracks of said plug-in card includes a directional coupler positioned therein.

10. An array antenna comprising:

a planar configured housing;

a dielectric substrate layer having opposing sides and mounted within said housing;

a ground plane conductor positioned on one side of said dielectric substrate layer;

a plurality of slots formed within the ground plane conductor, wherein said slots are arranged to form an array;

a plurality of signal tracks extending along the side of the dielectric substrate layer opposing the ground plane conductor, wherein respective signal tracks extend under each slot;

a plug-in card slot mounted on said housing and operatively connected to said plurality of signal tracks;

a plug-in card that had been selected out of a plurality of plug-in cards and inserted within said plug-in card slot, wherein said plug-in card has a plurality of signal tracks operatively connected to respective signal tracks extending along said substrate layer, wherein each of said signal tracks within said plug-in card are formed to have a desired phase shift to scan the beam to a desired, fixed location; and a directional guide for indicating direction in which the phase array antenna has been mounted on an object, and including a display indicating the plug-in card that had been selected to be mounted within said plug-in slot.

11. An array antenna according to claim 10, wherein said ground plane conductor further comprises a patch antenna element formed within each of said slots.

12. An array antenna according to claim 10, wherein said plug-in card has fixed line lengths determined by a desired phase shift.

13. An array antenna according to claim 10, wherein respective signal tracks extend under respective predetermined rows.

14. An array antenna comprising:

a first dielectric substrate layer having opposing sides;

a ground plane conductor positioned on one side of said dielectric substrate layer;

a plurality of slots formed within the ground plane conductor, wherein said slots are arranged to form an array;

a plurality of patch antenna elements positioned along the side of the dielectric substrate layer opposing the slotted ground plane conductor;

a second dielectric substrate layer positioned under said patch antenna elements;

a plurality of striplines extending along the second dielectric substrate layer positioned under said patch antenna elements;

a plug-in card slot operatively connected to said plurality of striplines;

a plug-in card that had been selected out of a plurality of plug-in cards and inserted within said plug-in card slot, wherein said plug-in card has a plurality of striplines operatively connected to respective striplines extending along said substrate layer, wherein each of said striplines within said plug-in card is formed to have a desired phase shift to scan the beam to a desired, fixed location; and a directional guide for indicating direction in which the phase array antenna has been mounted on an object, and including a display indicating the plug-in card that had been selected to be mounted within said plug-in slot.

15. An array antenna according to claim 14, wherein said striplines of said plug-in card has fixed line lengths determined by a desired phase shift.

16. An array antenna according to claim 14, wherein each of said striplines of said plug-in card includes a directional coupler positioned therein.

17. An array antenna according to claim 14, wherein respective striplines extend under respective predetermined rows.

* * * * *